US008091738B2

(12) United States Patent
Ciavarella

(10) Patent No.: US 8,091,738 B2
(45) Date of Patent: Jan. 10, 2012

(54) MANUAL SKIN-CARE PRODUCT DISPENSER

(75) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 434 days.

(21) Appl. No.: 12/316,783

(22) Filed: Dec. 16, 2008

(65) Prior Publication Data

US 2010/0147890 A1 Jun. 17, 2010

(51) Int. Cl.
*B67D 7/06* (2010.01)

(52) U.S. Cl. ..... 222/181.3; 222/182

(58) Field of Classification Search ..... 222/103, 222/180, 181.1, 181.2, 181.3, 182, 214
See application file for complete search history.

(56) References Cited

U.S. PATENT DOCUMENTS 4,223,812 A * 9/1980 van Lit ..... 222/180
4,324,348 A * 4/1982 Johnson et al. ..... 222/181.2
4,421,254 A * 12/1983 Spector ..... 222/180
4,932,562 A 6/1990 Christine
5,431,304 A 7/1995 Gentile
5,862,956 A 1/1999 Brandenburg et al.
6,152,330 A * 11/2000 Polan ..... 222/156
6,305,580 B1 10/2001 Chen
7,048,152 B2 5/2006 Bunoz
7,614,526 B2 * 11/2009 Gaillen ..... 222/162

FOREIGN PATENT DOCUMENTS

DE 296 01 918 U1 6/1997
FR 2 134 935 A5 12/1972

* cited by examiner

*Primary Examiner* — Kevin P Shaver
*Assistant Examiner* — Daniel R Shearer
(74) *Attorney, Agent, or Firm* — Renner Kenner Greive Bobak Taylor & Weber

(57) ABSTRACT

A product dispenser includes a housing having a backplate and a cover that, together, define a reservoir recess, and a refill unit received in the housing, the refill unit including a product reservoir positioned in the reservoir recess and holding product for dispensing, and a pump carried by the product reservoir and actuated to dispense the product. The cover pivots relative to the backplate and is pushed to pivot about a pivot point and actuate the pump. The pivot point is positioned such that the volume of the reservoir recess increases as the pump is actuated to dispense the product. The product reservoir may include a pair of cylindrical recess positioned on a common axis and projecting inwardly toward one another, and the cover may include a pair of inwardly projecting journals that are removably received in the cylindrical recesses, the cylindrical recesses and the journals acting together to form the pivot point of the cover.

5 Claims, 5 Drawing Sheets

MANUAL SKIN-CARE PRODUCT DISPENSER

TECHNICAL FIELD

The invention herein resides in the art of product dispensers including a housing that receives a product-filled refill unit for dispensing the product upon manual actuation of the dispenser. More particularly, the invention relates to an improved manually actuated product dispenser housing having a one-piece cover and pushbar that pivots about a cover axis that is positioned such that the cover does not intrude upon the internal volume of the dispenser, particularly at the location of the product carrying portion of the refill unit.

BACKGROUND OF THE INVENTION

For many years, it has been known to dispense liquids, such as soaps, sanitizers, cleansers, disinfectants, lotions, and the like from a dispenser housing maintaining a refill unit that holds the liquid and provides the pump mechanisms for dispensing the liquid. It is desirable in these product dispensers to provide a maximum internal volume to allow a greater quantity of liquid to be provided in a refill unit, thereby reducing the maintenance work required to keep the dispenser filled. These dispenser housings generally include a back plate that is wall-mounted and a cover hinged to the backplate to pivot between an open position, wherein a refill unit can be removed or installed, and closed position, wherein the dispenser can be actuated to dispense product.

A pushbar is often hinged to the cover and pivoted to cause the dispensing of product from a refill unit retained in the housing. However, some dispensers employ a single piece integral cover and pushbar wherein the cover pivots as a whole to actuate the pump mechanics of the refill unit within the housing. These types of dispensers are often desired due to their appearance and simplicity of construction since the pushbar is not a separate hinged element. The pump mechanism employed with such dispensers has typically been a liquid pump or a foam generating pump, simply emitting a predetermined quantity of the liquid or foam upon movement of the cover/pushbar.

In the prior art, dispensers having a single piece cover/pushbar included a pivot point at the top of the dispenser, where the cover is pivotally secured to the backplate. As can be appreciated, when the cover of such a dispenser is pressed to actuate a pump, the cover pivots so that it intrudes upon the internal volume of the dispenser, or, stated differently, the portion of the cover below the pivot point (which is essentially the entire cover) moves toward the backplate, decreasing the volume within the housing. As a result, refill units must be made smaller to allow for this intrusion upon the internal volume of the dispenser by the cover/pushbar, thereby reducing the amount of liquid that can be supplied in a single refill unit, and increasing the frequency of installing new refill units. Thus, there is a need for a product dispenser with a one-piece cover and pushbar that does not intrude upon the internal volume of the dispenser housing when actuated.

SUMMARY OF THE INVENTION

A product dispenser including a housing having a backplate and a pivoting single-piece cover fitted with the backplate to define a reservoir recess. The cover has a pair of inwardly projecting journals that define a cover axis about which the cover pivots. A refill unit is received in the reservoir recess between the backplate and the cover. The refill unit includes a product reservoir holding product for dispensing that has a bottom end and a pump carried by the product reservoir proximate to the bottom end that is actuated to dispense the product. The single piece cover is pivotally supported on the inwardly projecting journals to pivot about the cover axis such that pushing on the cover toward the backplate, at a position below the cover axis, actuates the pump. When the pump is actuated the volume of the reservoir recess above the cover axis to increase, the cover axis being positioned either adjacent to or below the bottom end of the product reservoir.

DETAILED DESCRIPTION OF THE INVENTION

Figure 1:
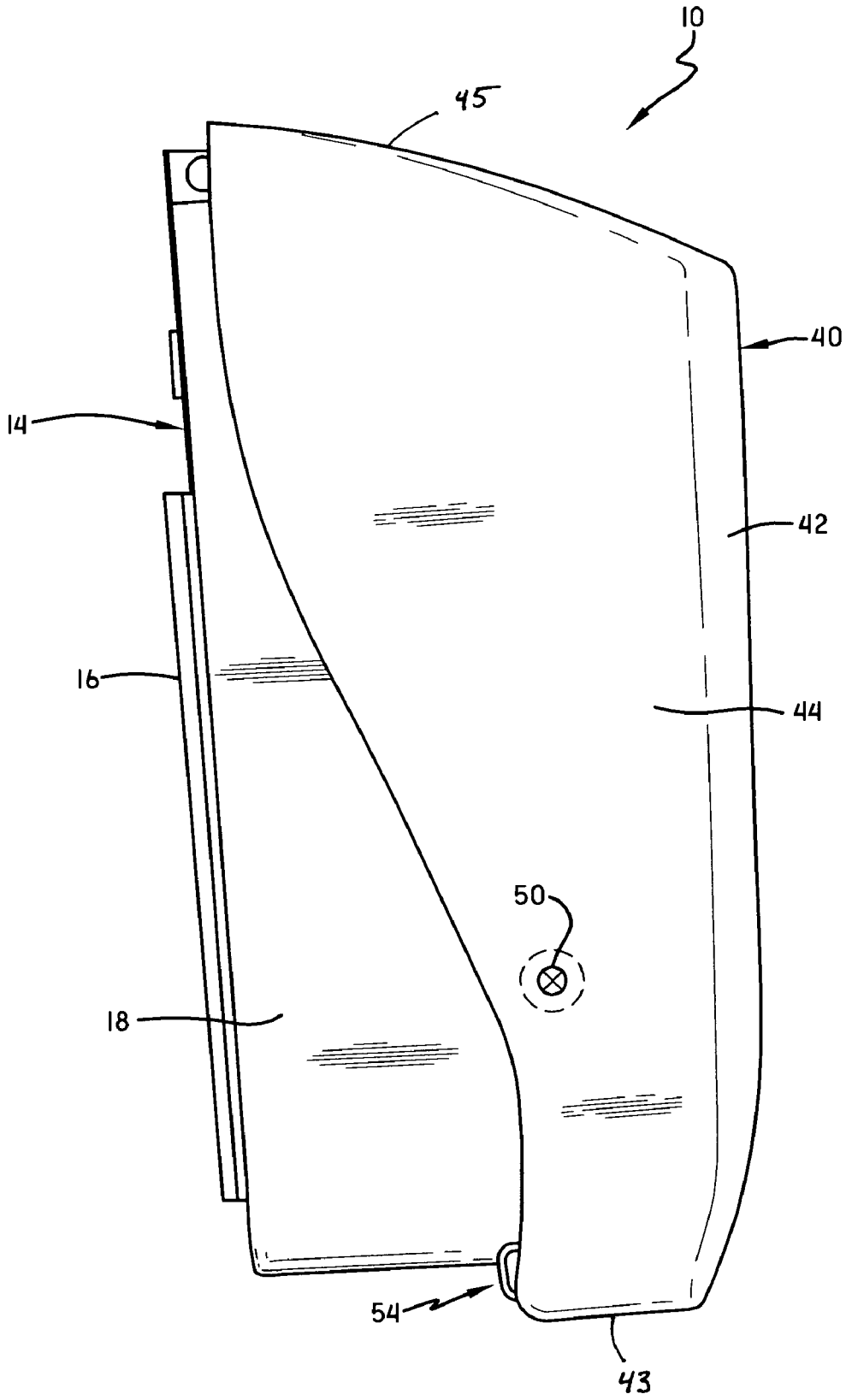
FIG. 1 is a side view of the product dispenser of the present invention in a rest state.

A manual product dispenser according to the concepts of the present invention is shown in FIGS. 1-5 and is indicated generally by the numeral 10. Dispenser 10 may be employed to dispense any known liquid product, and will be particularly useful in dispensing skin-care products such as, for example, soaps, sanitizers, cleansers, disinfectants, and the like. Dispenser 10 includes a housing 14 having a backplate 16, sidewalls 18, and a single piece cover 40. Sidewalls 18 extend generally orthogonally from the top, bottom, and sides of backplate 16, and, together with backplate 16, form a recess 20 (FIG. 4) within housing 14. Housing 14 may be provided in any number of sizes and with a variety of different aesthetic features to make dispenser 10 more visually appealing. Housing 14 may also include slots or bores therein, as will be discussed in greater detail below. The backplate 16 may be mounted to a wall by any means known to persons having ordinary skill in the art, such as, for example, by the use of threaded fasteners extending through backplate 16 and into the wall.

Figure 4:
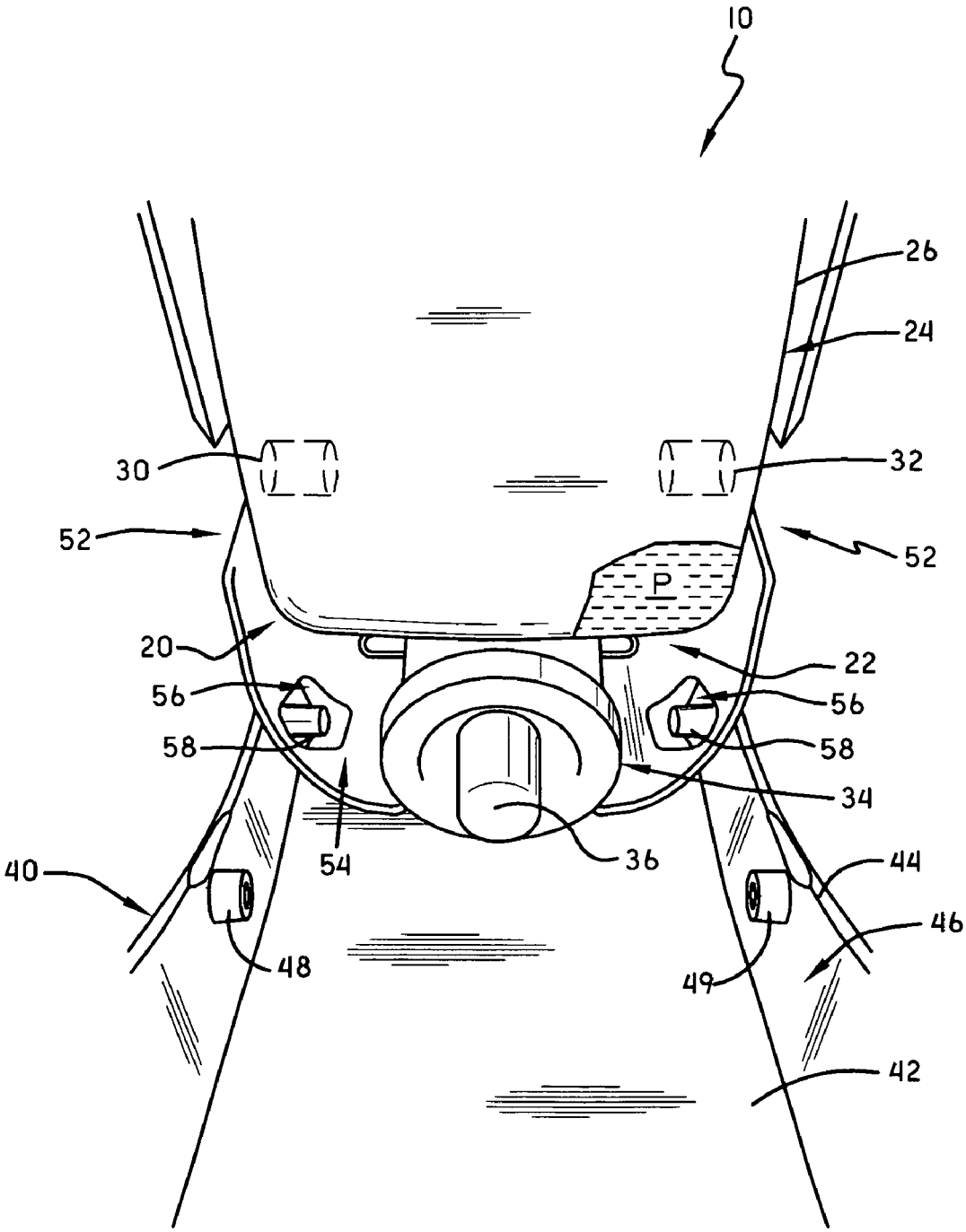
FIG. 4 is a front perspective of the product dispenser of the present invention in an opened state showing a refill unit inserted in the housing.
Figure 5:
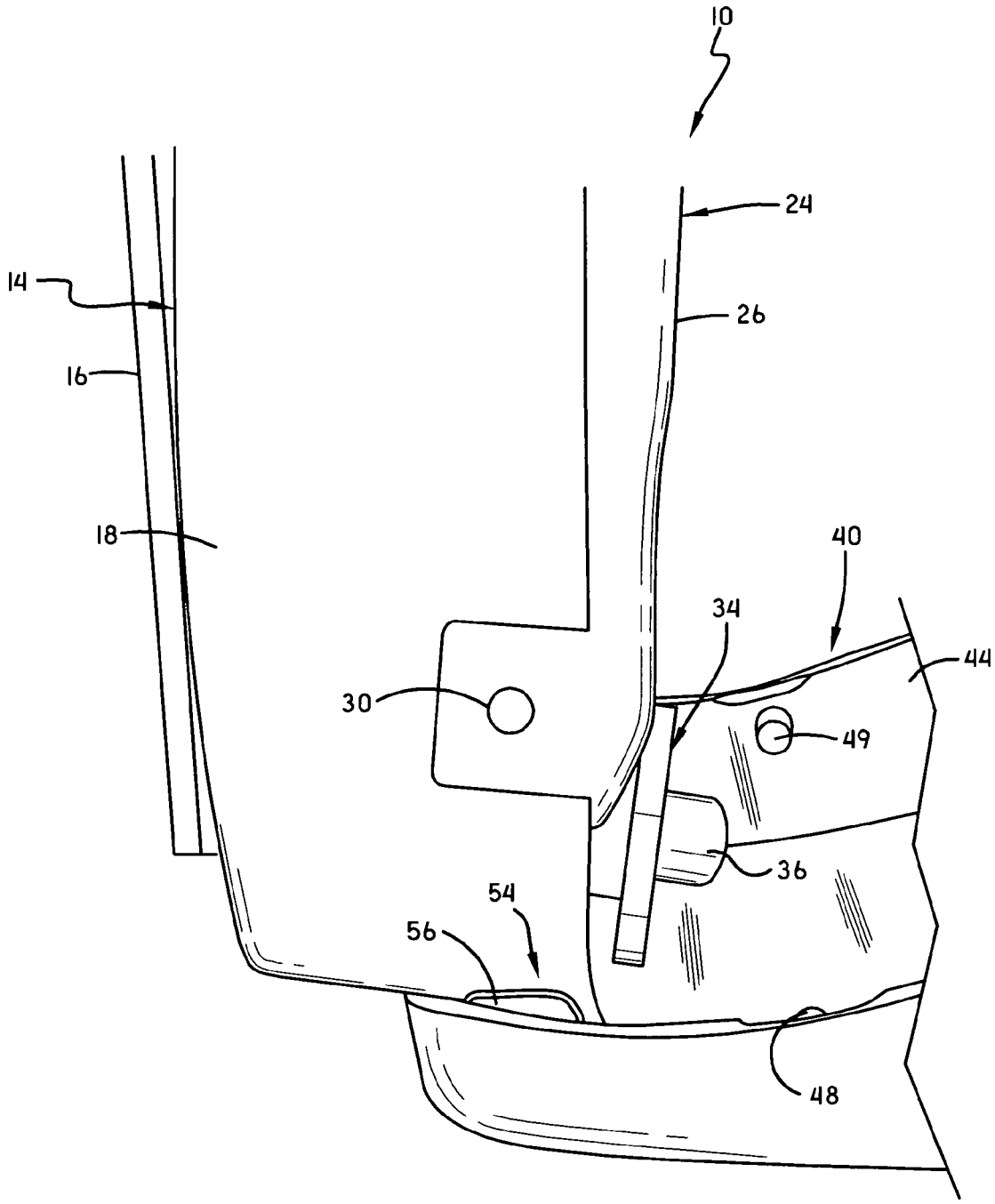
FIG. 5 is a side view of the product dispenser in an opened state.

Dispenser 10 also includes a refill unit 22 received within recess 20 of housing 14. Refill unit 22 is removably secured within housing 14 so that it may be replaced as necessary. Any method of securing a refill unit within a dispenser known to persons of ordinary skill in the art may be used to ensure that refill unit 22 remains within housing 14 unless otherwise desired. Refill unit 22 includes a product reservoir 24 having an outer shell 26 defining an inner volume that contains product P to be dispensed (FIG. 4). As is well known in the art, product reservoir 24 may be made of a substantially non-flexible plastic material so as to provide a constant volume container for product P or may be made of films or other materials so as to be collapsible. It is preferable for product reservoir 24 to be as large as possible while still fitting within recess 20 so as to provide a maximum quantity of product in a single refill unit.

In this particular embodiment product reservoir 24 includes a pair of cylindrical recesses 30, 32. Cylindrical recesses 30 and 32 are located on opposing sides of the outer shell 26 of product reservoir 24 and protrude into the inner volume towards one another. Cylindrical recesses 30 and 32 are located on a common center axis that is oriented generally horizontally.

Refill unit 22 also provides a pump 34 necessary for dispensing liquid product P, and may also include foam pumps which mix the liquid product P with air before dispensing, generating a foam product. In the case of foam pumps, both air and liquid pumps may be provided as part of pump 34 to supply air and liquid to a mixing chamber within pump 34 to create the desired foam product. As an alternative, a foam pump may be provided by joining a refill unit carrying only a liquid pump with a housing carrying an air pump. Pump 34 is secured to product reservoir 24, and is in fluid communication therewith. Pump 34 also includes an outlet nozzle 36 extending from pump 34 that dispenses product P when dispenser 10 is actuated. More particularly outlet nozzle 36 is part of a piston portion of a piston pump, as is well known in the art. The piston is slidingly received in or around, and partially defines, a mixing chamber. When the piston is caused to move toward pump 34, the volume within the mixing chamber decreases, thereby causing liquid or foam to be discharged through a one way valve and through outlet nozzle 36. When the pressure acting upon the piston is released, the piston is caused to return to its starting position by a biasing force, thereby creating a vacuum within the mixing chamber. The vacuum created by the expansion of the mixing chamber draws liquid from product reservoir 24 through a one way valve and into the mixing chamber where it is ready to be expelled when the dispenser is actuated.

In accordance with this invention, the single piece cover 40 operates as a pushbar actuator for pump 34. Cover 40 has a face 42, a bottom wall 43, sidewalls 44, and a top wall 45 that form a cavity 46. Cover 40 has approximately the same dimensions as housing 14, but is slightly larger so that sidewalls 44 of cover 40 fit over and around sidewalls 18 of housing 14. Cover 40 may also be provided with a notch (not shown) in bottom wall 43 that allows dispensed product to flow from nozzle 36 to a users hand positioned beneath the notch when dispenser 10 is actuated. As with housing 14, cover 40 may be provided with a variety of aesthetic features that are not material to the present invention. Cover 40 may optionally include a window positioned to permit the level of fluid within the product reservoir to be examined. Cover 40 also includes a pair of inwardly projecting journals 48 and 49 extending into cavity 46 from sidewalls 44. Journals 48 and 49 are positioned on a common central axis that is oriented substantially horizontally.

Cover 40 fits over housing 14 so that there is at least a minimal amount of overlap between sidewalls 44 and sidewalls 18 to hide the internal components of dispenser 10. Journals 48 and 49 are received in cylindrical recesses 30 and 32 of product reservoir 24, thus creating a cover axis 50 about which cover 40 can rotate. Sidewalls 18 of housing 14 may provide slots 52 to accommodate journals 48 and 49 as cover 40 is slid into position. Here, the product reservoir is a rigid container, but the product reservoir may alternatively be provided as a film or other collapsible material, and an alternative mounting point to recesses 30 and 32 may be provided in housing 14, as will be appreciated by those skilled in the art. In this embodiment, nozzle 36 protrudes through opening 47 of face 42, with a portion of face 42 adjacent opening 47 resting against an actuating portion of pump 34, as is known in the art. When cover 40 is pressed at a position below cover axis 50 and in the direction toward backplate 16, as shown in FIG. 2, pump 34 is actuated, causing product P to be dispensed from nozzle 36.

A means of facilitating disassembly of dispenser 10 may be incorporated into housing 14 and cover 40, as is well known in the art of liquid dispensers. For example, channels may optionally be provided in sidewalls 18 of housing 14 adjacent to slots 52 to facilitate gripping cover 40 adjacent to journals 48 and 49, while sidewalls 44 of cover 40 may be provided with flexible tabs in the region surrounding and including journals 48 and 49. As will be appreciated by those skilled in the art, the channels and flexible portions in sidewalls 18 and 44 are incorporated to facilitate removal of cover 40 when refilling dispenser 10 by allowing a user to grip and pull out on the flexible tabs to remove journals 48 and 49 from their recesses and permit cover 40 to be pulled away from housing 14.

Figure 2:
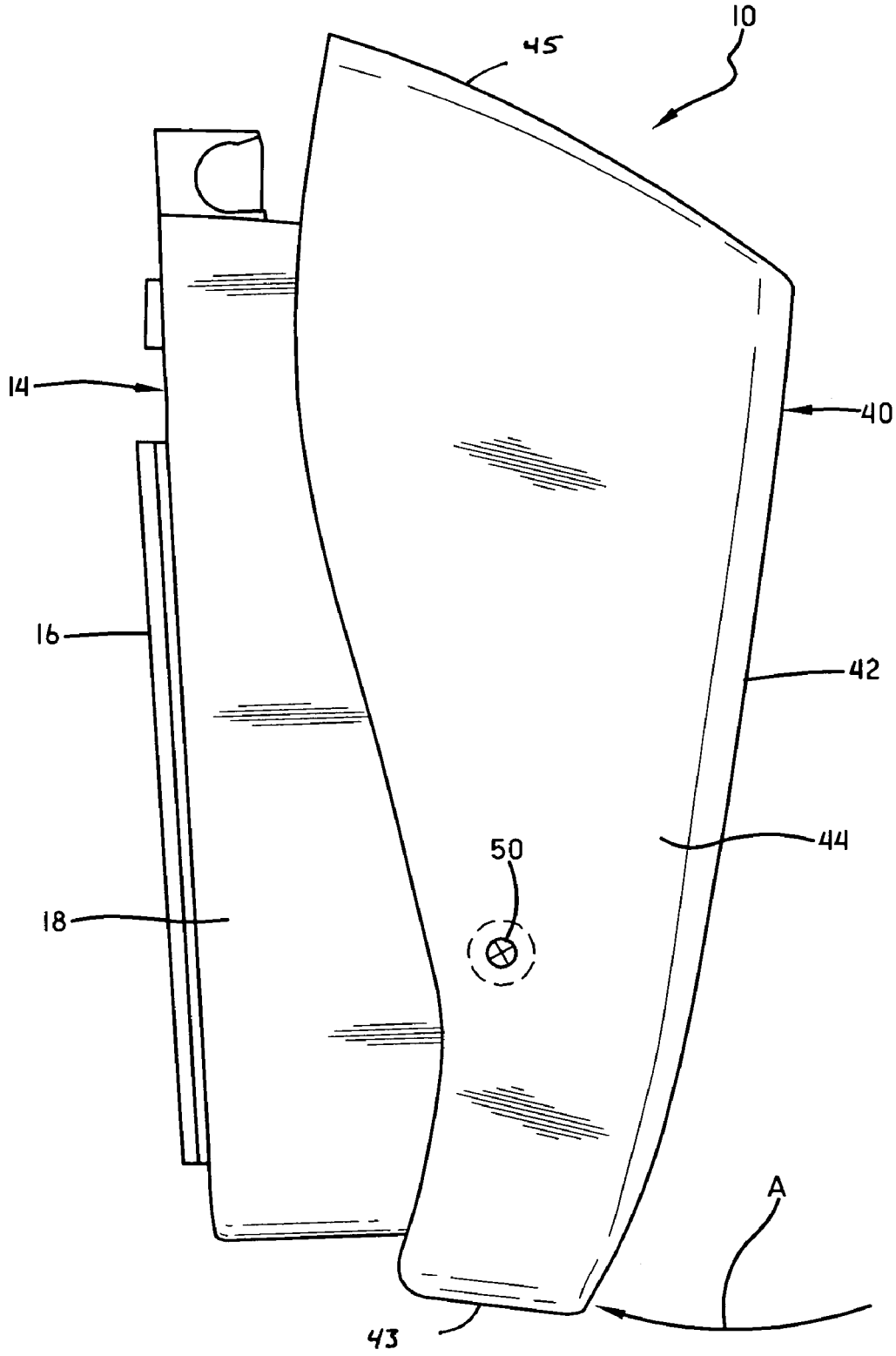
FIG. 2 is a side view of the product dispenser of the present invention in an actuated state.

With reference to FIGS. 1 and 2, which show dispenser 10 in a rest state and an actuated state respectively, cover 40 pivots about cover axis 50 when pressed toward backplate 16 at a position below cover axis 50 so that the portion of cover 40 below cover axis 50 moves toward backplate 16 while the portion of cover 40 above cover axis 50 moves away from backplate 16. Thus, as can be appreciated, the amount of space within the enclosure created by housing 14 and cover 40 actually increases in volume when cover 40 is pressed because a greater portion of cover 40 is pivoting away from housing 14 than is pivoting towards it. More specifically, the inner volume of the portion of housing 14 above cover axis 50 increases while the inner volume of the portion of housing 14 below cover axis 50 only slightly decreases.

The location of cover axis 50 in dispenser 10 is significant in permitting the desired operation. Preferably, cover axis 50, and consequently cylindrical recesses 30 and 32 and journals 48 and 49, are located proximate to the edge of sidewalls 18 of housing 14 and sidewalls 44 of cover 40, and below product reservoir 24, as is shown. Even more preferably, cover axis 50 is located adjacent the bottom of product reservoir 24 when it is received in housing 14 so that when cover 40 is pressed, the inner volume of the portion of housing 14 above cover axis 50 that holds product reservoir 24 increases. By avoiding a reduction in the inner volume of housing 14 above cover axis 50, a product reservoir may be provided that has a larger capacity, which reduces the frequency of refilling the dispenser. After actuation, cover 40 is returned to a rest state, as seen in FIG. 1, by a biasing mechanism that may be provided within pump 34, or between cover 40 and the remainder of housing 14.

Figure 3:
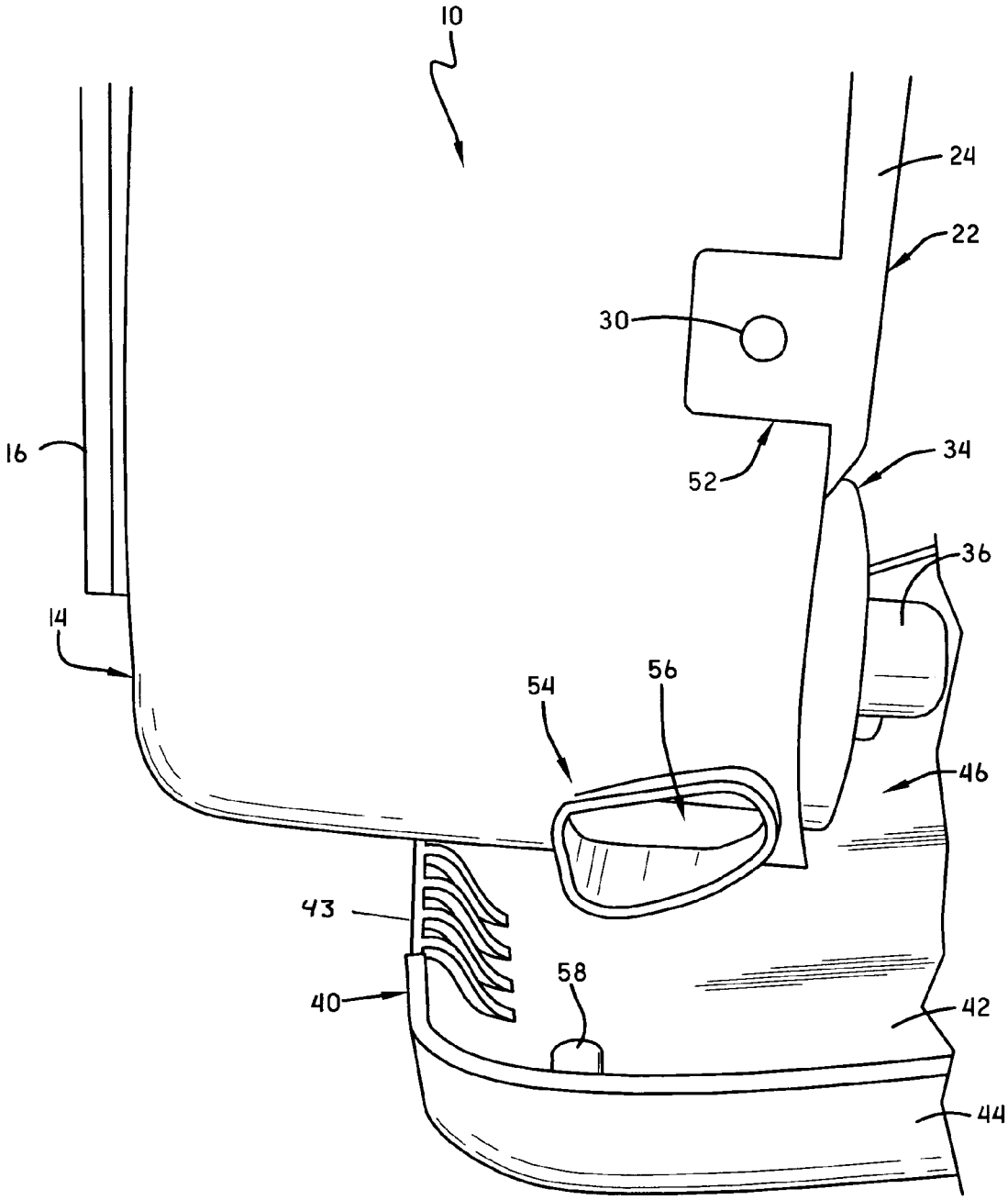
FIG. 3 is a perspective view of the product dispenser showing the cover in an open and disassembled state.

Dispenser 10 may optionally be provided with a guide mechanism 54, including guide slots 56 adapted to receive guide members 58 on cover 40. As best seen in FIG. 3, guide slots 56 are located in sidewalls 18 of housing 14 adjacent pump 34 and are elongated in a horizontal direction. Guide members 58 are located adjacent to the bottom end of cover 40 and project inwardly from sidewalls 44. When cover 40 is installed over housing 14, guide members 58 project into guide slots 56 and act to maintain cover 40 in a desired orientation during actuation of pump 34. Guide mechanism 54 also provides a stopping point for cover 40 when it is moving in the actuating direction toward housing 14, and when it is returning from an actuating position to a rest position. Finally, guide mechanism 54 and guide members 58 interact to keep the cover 40 associated with the dispenser 10 even when journals 48, 49 are removed from cylindrical recesses 30, 32. When so removed, cover 40 can pivot on guide members 58 to open access to recess 20, because cover 40 is no longer restricted to pivot at cover axis 50. This facilitates replacement of an empty refill unit 22.

In light of the foregoing, it should be clear that this invention provides improvements in the art of skin-care product dispensers. While a particular embodiment has been disclosed herein for the purpose of teaching the inventive concepts, it is to be appreciated that the invention is not limited to or by any particular structure shown and described. Rather, the claims shall serve to define the invention.

What is claimed is:

1. A product dispenser comprising:

(a) a housing including a backplate and a pivoting single-piece cover fitted with said backplate to define a reservoir recess, said cover having a pair of inwardly projecting journals; and (b) a refill unit received in said reservoir recess between said backplate and said cover, said refill unit including:

(i) a product reservoir holding product for dispensing and having a bottom end disposed in said reservoir recess, and (ii) a pump carried by said product reservoir proximate said bottom end and actuated to dispense said product;

wherein said single piece cover is pivotally supported on said inwardly projecting journals to pivot about a cover axis defined by said inwardly projecting journals, such that pushing on said cover toward said backplate, at a position below said cover axis, actuates said pump and causes the volume of said reservoir recess above said cover axis to increase, said cover axis being positioned either adjacent to or below said bottom end of said product reservoir.

2. The product dispenser of claim 1, further comprising a pair of guide members projecting inward from said single-piece cover adjacent to a bottom end of said cover, and a pair of guide slots in said backplate, wherein said guide members are received in said guide slots to guide said single piece cover as it pivots and to provide a pivot point to allow opening of the dispenser for refilling.

3. The product dispenser of claim 1, wherein said backplate includes sidewalls extending therefrom.

4. The product dispenser of claim 3, wherein said sidewalls provide recesses to receive said inwardly projecting journals and define said cover axis.

5. The product dispenser of claim 1, wherein said product reservoir provides recesses to receive said inwardly projecting journals and define said cover axis.

* * * * *